United States Patent [19]

Hamisch, Jr.

[11] 4,044,677

[45] Aug. 30, 1977

[54] INKING MECHANISM

[75] Inventor: Paul H. Hamisch, Jr., Franklin, Ohio

[73] Assignee: Monarch Marking Systems, Inc., Dayton, Ohio

[21] Appl. No.: 604,389

[22] Filed: Aug. 13, 1975

[51] Int. Cl.[2] ..... B41K 3/60; B41F 1/46; B41F 31/33

[52] U.S. Cl. ..... 101/348; 101/103; 101/320; 101/295; 101/310; 101/314; 101/335; 101/364; 101/359

[58] Field of Search ..... 101/287, 288, 295, 305, 101/309, 310, 314–316, 320, 321, 335, 348, 363, 364, 367, 359, 103; 403/331, 381

[56] References Cited

U.S. PATENT DOCUMENTS

| | | | |
|---|---|---|---|
| 1,244,524 | 10/1917 | Marshall | 101/352 X |
| 1,899,846 | 2/1933 | Boyd | 403/331 |
| 2,133,252 | 10/1938 | Moore et al. | 403/332 |
| 3,347,159 | 10/1967 | Altonji et al. | 101/93.28 |
| 3,491,685 | 1/1970 | Tramposch | 101/367 |
| 3,759,178 | 9/1973 | Franchinot et al. | 101/349 |
| 3,785,288 | 1/1974 | Hunter | 101/348 |
| 3,786,547 | 1/1974 | O'Conner | 101/348 |
| 3,878,783 | 4/1975 | Hamisch | 101/348 |
| 3,891,335 | 6/1975 | Feil | 403/381 |
| 3,902,952 | 9/1975 | Penaluna | 101/295 |

*Primary Examiner*—Ernest T. Wright, Jr.
*Assistant Examiner*—William Pieprz
*Attorney, Agent, or Firm*—Joseph J. Grass

[57] ABSTRACT

There is disclosed a printing apparatus having a print head and an inking mechanism for inking the print head. The inking mechanism comprises an ink roller, an inker body or carrier for the ink roller and structure for movably mounting the inker body. The ink roller is rotatably mounted to the inker body by mounting means including a pair of mounting members. The inker body has a pair of undercut slots and the mounting members have respective flanges received in the slots. Each mounting member is shown to have a resilient member or finger engageable with a respective shoulder on the inker body to lock the mounting member to the inker body. The inking mechanism has means for preventing its disconnection from the printing apparatus while the inking mechanism is in cooperation with the print head, but the inking mechanism can be removed and replaced with a new inking mechanism having a new ink roller while the inking mechanism is out of cooperation with the print head.

19 Claims, 14 Drawing Figures

FIG-1
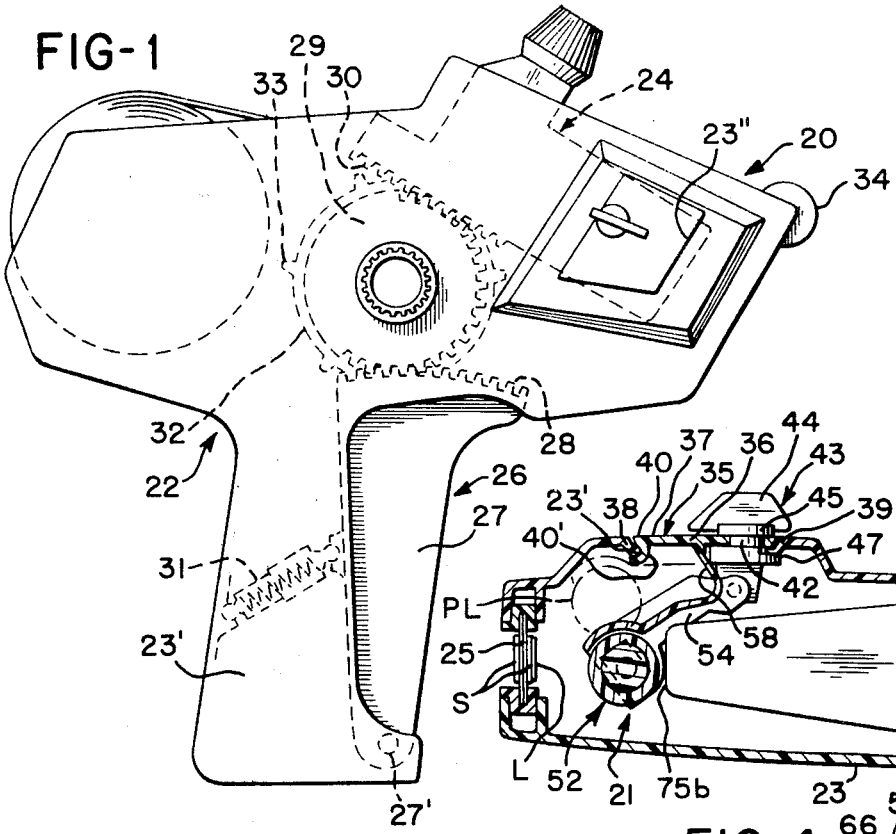
FIG-2
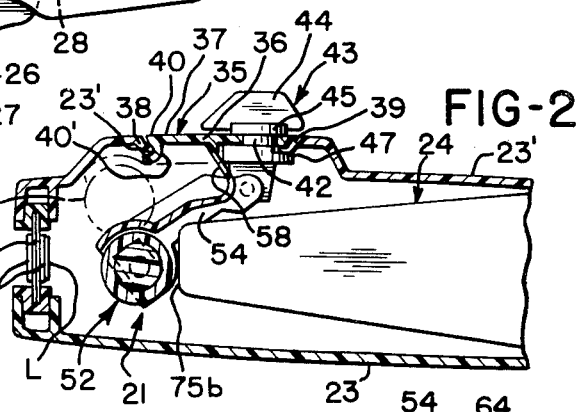
FIG-3
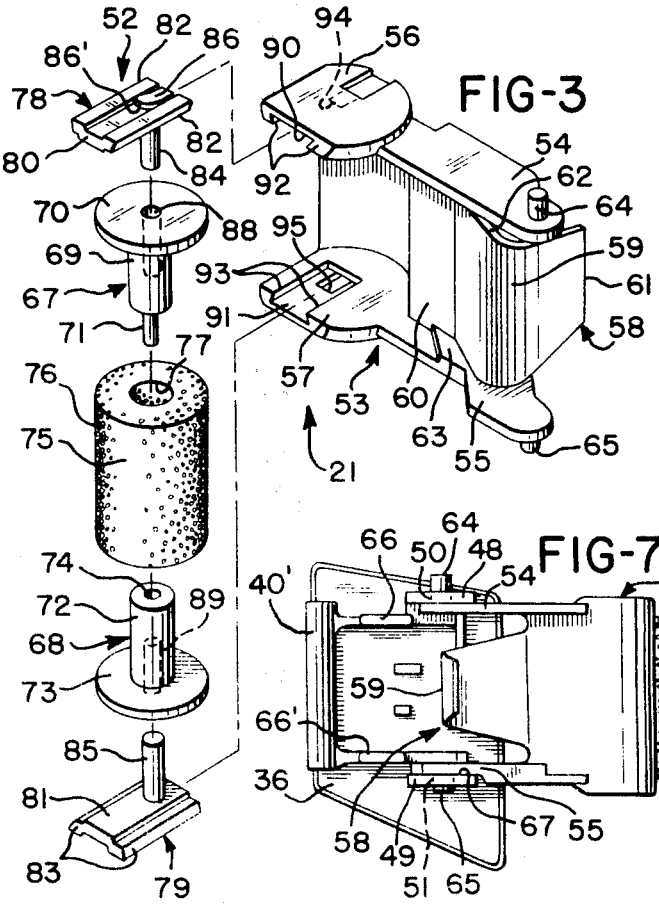
FIG-4
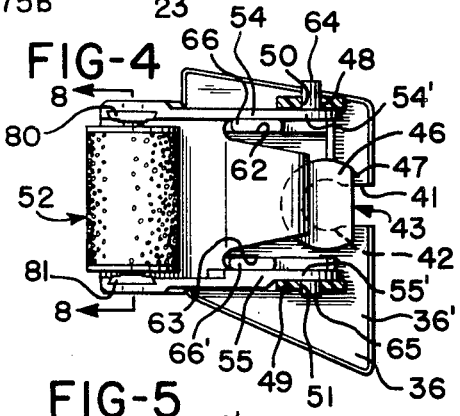
FIG-5
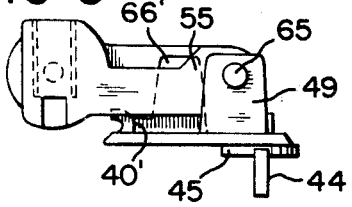
FIG-6
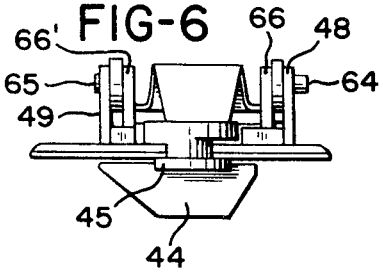
FIG-7

INKING MECHANISM

BACKGROUND OF THE INVENTION

1. Field of the Invention

This invention relates to the art of inking mechanisms for printing apparatus.

2. Brief Description of the Prior Art

In a prior art development of William A. Jenkins and Paul H. Hamisch, Jr. disclosed in U.S. Pat. No. 3,798,106 granted Mar. 19, 1974, there is disclosed an inking mechanism having an inker body, an ink roller, and means, in particular a cover, for mounting the inker body and the ink roller to a printing apparatus. The inker body has an integrally formed curved spring finger which acts on the cover to urge the ink roller into cooperation with the print head. The flanges on the ink roller cooperate with bearing surfaces on the print head. Manufacturing variations in the molding process sometimes cause the spring finger on some of the inker bodies to be defective, resulting in breakage of the spring finger. Apparatus of the type disclosed in the above-mentioned patent is ruggedly constructed to withstand considerable abuse such as being dropped. Nevertheless, it has happened that upon being dropped the projections which mount the inker body to the cover have become unsnapped from the respective sockets, thereby requiring the user to resnap the ink roller to the body before the apparatus can be used again.

SUMMARY OF THE INVENTION

According to a specific embodiment of the invention, the ink roller is shown to be comprised of a pair of connected hub sections, with each hub section having a roll mounting portion and a flange. Porous ink receptive material is mounted on the roll mounting portions between the flanges. Each hub section has an axially extending hole. There are a pair of mounting members for rotatably mounting the ink roller to the inker body. Each mounting member includes a body having a pair of flanges, a resilient member or finger, and a stub end or shaft. Each mounting member is of one-piece molded plastics construction. The inker body has a pair of slots in which the mounting members are slidably received. It is preferred that the slots be undercut and that flanges of each mounting member be received in the respective slots. The inker body also includes two pairs of shoulders. When the mounting members have been inserted into the respective slots, the resilient members engage one shoulder of each pair and prevent accidental dislodgment of the mounting members. Once assembled, the mounting members are held captive by the inker body and the respective shafts hold the ink roller captive. In accordance with another aspect of the invention, the inking mechanism can be readily connected to its mounting structure, specifically a cover, so that an inker body with a spent ink roller can be readily replaced with an inker body having a fresh ink roller. However, when the inking mechanism is in position in cooperation with the print head, the inking mechanism cannot be dislodged from its mounting position in the apparatus due to interference or blocking members. In accordance with the specific embodiment, the inker body has a pair of mounting arms which are preferably spaced apart from a spring finger which is disposed between the arms. The mounting structure, specifically the cover, has at least one and preferably two interference members which, in the operative position of the inking mechanism, provide interference against the arms deflecting and becoming dislodged from the cover. The interference member or members are so positioned that when the inking mechanism is moved to a different position, the interference members no longer cause interference and the arms can be deflected for removal of the inking mechanism.

BRIEF DESCRIPTION OF THE DRAWINGS

FIG. 1 is a side elevational view of a label printing and applying apparatus embodying the inking mechanism of the invention;

FIG. 2 is a sectional view through the apparatus showing the relationship of the inking mechanism, the cover, the print head, and the platen to the remainder of the apparatus;

FIG. 3 is an exploded perspective view of the inking mechanism;

FIG. 4 is a view of the inking mechanism and the underside of the cover as they would appear in the phantom line position in FIG. 2;

FIG. 5 is a side elevational view of the inking mechanism and the cover shown in FIG. 4;

FIG. 6 is a right side elevational view of the inking mechanism and cover shown in FIG. 5;

FIG. 7 is a view similar to FIG. 4 but showing the inking mechanism in a different position relative to the cover;

DETAILED DESCRIPTION OF THE PREFERRED EMBODIMENT

Figure 8:
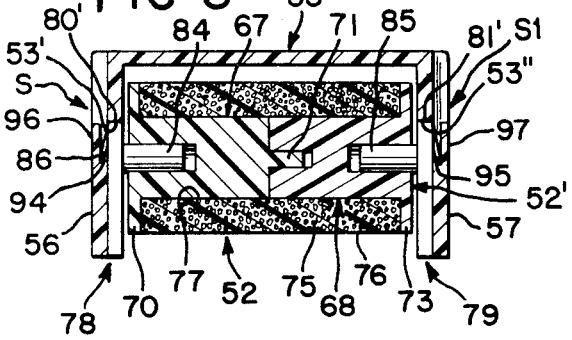
FIG. 8 is a sectional view of the ink roller, the inker body and mounting members for rotatably mounting the ink roller to the inker body.
Figure 9:
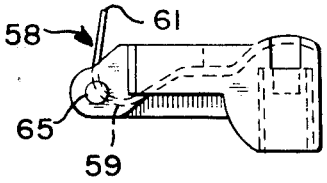
FIG. 9 is an elevational view showing one side of the inker body.
Figure 11:
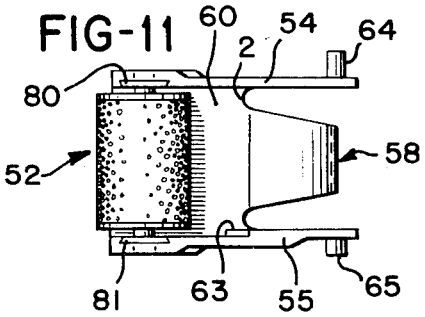
FIG. 11 is a plan view of the inker body and ink roller in the assembled condition.
Figure 10:
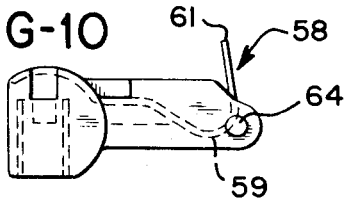
FIG. 10 is an elevational view showing the other side of the inker body.
Figure 14:
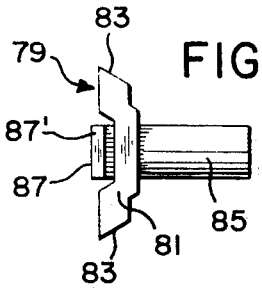
FIG. 14 is a top plan view of the mounting member shown in FIGS. 12 and 13.
Figure 12:
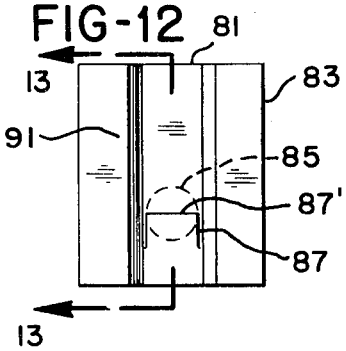
FIG. 12 is an enlarged side elevational view of one of the mounting members.
Figure 13:
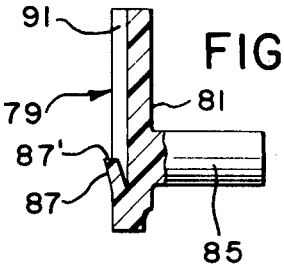
FIG. 13 is a sectional view taken generally along 13—13 of FIG. 12.

With reference to FIG. 1, there is shown a label printing and applying apparatus generally indicated at 20 substantially identical to the apparatus shown in FIGS. 1 and 3 through 27 and described in the specification of U.S. Pat. No.3,798,106, except for the inking mechanism generally indicated at 21 which is shown in whole or in part in FIGS. 2 through 14 of the present application. Reference may be made to the disclosure in U.S. Pat. No. 3,798,106 for additional constructional details, the disclosure of which is incorporated herein by reference.

The apparatus 20 has a housing generally indicated at 22 comprised of housing sections 23 and 23'. The housing 22 suitably mounts a print head generally indicated at 24 for reciprocating movement into and out of printing cooperation with a label L carried on a web of supporting material S. A label L is disposed between a print head 24 and a platen 25. An actuator generally indicated at 26 is shown to comprise a lever 27 pivotally mounted on a pivot 27'. The lever 27 carries a pair of gear segments 28 (only one of which is shown). The housing mounts a pair of gears 29 (only one of which is shown) in mesh with the respective gear segments 28. The print head 24 carries a pair of gear sections 30 (only one of which is shown) in mesh with respective gears 29. When the lever 27 is pivoted counterclockwise as viewed in FIG. 1, the gear segments 28 rotate the gears 29 clockwise and the print head 24 is driven into printing cooperation with a label L and the platen 25. Upon release of the lever 27, a return spring assembly 31 drives the lever 27 clockwise, thereby causing the gear 29 to rotate counterclockwise to drive the print head 24 to the initial position shown in FIGS. 1 and 2. Mounted coaxially with the gears 29 is a feed wheel 32 having a plurality of radially spaced-apart teeth 33 for engaging and driving the support material web S. During return of the print head 24 to its initial position, one of the gears 24 causes a pawl and ratchet mechanism (not shown) to drive the feed wheel 32 so that the just printed label L is advanced into label applying relationship to an applicator 34 and an unprinted label L is advanced to the printing position between print head 24 and the platen 25.

The housing section 23 has an opening 23''. Means for mounting the inking mechanism generally indicated at 35 in the form of a cover or door 36 is provided for the opening 23''. The cover 36 has a generally planar portion 37 which rests against lips or lands 38 and 39 of the housing 23. The cover 36 has flanges or lips 40 and 40' which can straddle the land 38 to key one edge of the cover 36 to the housing 23. The planar portion 37 has a cutout or slot 41 in which annular portion 42 of a one-piece injection molded latch 43 is received. The latch 43 has a knob 44, an enlarged annular member 45 joining the annular portion 42 and the knob 44, and a portion 46 having a generally annular contour except for a flat 47. When the cover 36 is to be latched to the housing section 23, the latch 43 is positioned as shown in FIG. 4. The inking mechanism 21 which is carried by the cover 36 is inserted through the opening 34 and the flanges 40 and 40' are received about the flange 38 and marginal edge 36' of the cover 36 is brought against the flange 39 of the housing section 23. Upon rotation of the knob 44 to the position shown in FIGS. 1 and 2, the circular portion 46 of the latch 43 is brought into overlying relationship with respect to the flange 39 so that the flange 39 is trapped between the marginal edge 36' and the annular portion 46.

The cover 36 carries a pair of integrally formed projections or arms 48 and 49. The projections 48 and 49 have annular holes or sockets 50 and 51 which are axially aligned with respect to each other. The inking mechanism 21 includes an ink roller generally indicated at 52 and an inkler body generally indicated at 53. The inker body 53 has a pair of flexible resilient mounting arms or mounting members 54 and 55 which are shown to be generally parallel to each other. The inker body 53 also has ink roller mounting portions 56 and 57 disposed at one end portion of the inker body 53. A spring or spring finger 58 has a curvature 59 disposed between one end portion 60 where the spring finger 58 is connected to the inker body 53 and another end portion 61. In FIGS. 3, 7, 9, 10 and 11 the spring finger 58 is shown in the as-molded condition in which there is a predetermined curvature as indicated at 59. The spring finger 58 is stressed in the position shown in FIGS. 2, 4, 5 and 6 and exerts a spring force on the cover 36. As shown in the drawings, the arms 54 and 55 are spaced outwardly of the spring finger 58, thereby providing gaps 62 and 63. Projections or stub ends 64 and 65 carried by the respective arms 54 and 55 are shown to extend outwardly relative to each other. The projections 64 and 65 are shown to be received in the sockets 50 and 51. The sockets 50 and 51 and projections 64 and 65 are shown to be annular so that the ink body 53 is pivotally mounted with respect to the cover 36. The projection 64 is longer than the projection 65.

The cover 36 also carries a pair of interference members or projections 66 and 66'. The projections 48 and 49 are shown to be generally rectangular in section, extend parallel to each other, and are formed integrally with the cover 36. The members 66 and 66' are also shown to be generally rectangular, extend parallel to each other, to be parallel but offset from the members 48 and 49, and are formed integrally with the cover 36. In assembling the inker body 53 and the ink roller 52 which it mounts onto the cover 36, the projection 64 is first inserted into the respective socket 50 as best shown in FIG. 7. Thereafter, the arm 55 is deflected inwardly, namely toward the spring finger 58 and the arm 54 so that the projection 65 can clear the socket 51. In attempting to align the projection 65 with the socket 51, the terminal or free end of the projection 65 is slid along face 67 of the projection 49. When the projection 65 is aligned with the socket 51, the projection 65 snaps into the socket 51 and the inker body 53 is now pivotally mounted to the cover 36. The interference members 66 and 66' do not interfere in any way with assembly of the inker body 53 onto the cover 36 into the position shown in FIG. 7. However, when the inker body is pivoted into the positions shown for example in solid and phantom lines in FIG. 2, in which the spring finger 58 contacts the cover 36, the arm 54 is between the projections 48 and 66 and the arm 55 is between the projections 49 and 66' as best shown in FIGS. 4, 5 and 6. In that position the projections 66 and 66' are in the respective gaps 62 and 63. In the positions shown in FIGS. 4, 5 and 6, the end portion 54' of the arm 54 cannot flex enough to enable the projection 64 to come out of the socket 50 and the end portion 55' of the arm 55 cannot flex enough to enable the projection 65 to come out of the socket 51, when for example the apparatus is dropped. Accordingly, the projections 64 and 65 are completely captive in the respective sockets 50 and 51. Should the apparatus 20 be dropped, the inking mechanism 21 will remain securely connected to the cover 36. In the solid line position of the inking mechanism 21 (FIG. 2), the ink roller 52 bears against the print head 24 in one extreme position and the interference members 66 and 66' prevent the projections 64 and 65 from coming out of the respective sockets 55 and 51. In the position shown by phantom lines PL, the housing section 23 prevents the inking mechanism 21 from pivoting to a position in which members 66 and 66' would be ineffective. Thus, the inking mechanism 21 while assembled onto the apparatus 20 as shown in FIG. 2 is confined to operate throughout a position in which interference members 66 and 66' are effective. In that the projection 64 is relatively long as compared to the projection 65, it would be relatively safe to provide only one interference member, namely the interference member 66'. However, as an added precaution it is preferred to provide the two interference members 66 and 66'.

With reference to FIGS. 3 and 8, the ink roller 52 is shown to have a hub 52' comprised of a pair of hub sections generally indicated at 67 and 68. The hub section 67 has a rollmounting portion 69, an annular flange 70, and a projection or stud 71. The hub section 68 has a roll-mounting portion 72, an annular flange 73, and a hole 74 in which the projection 71 is received. A generally tubular roll 75 having an outer surface 76 and an axial through-hole 77 is received about the rollmounting portions 69 and 72 of hub 52' between flanges 70 and 73. The roll 75 is composed of a porous elastomeric ink-receptive material. Flanges 70 and 73 bear against spaced apart bearing surfaces 75 *b* at opposite sides of the print head 24.

A pair of mounting members generally indicated at 78 and 79' have respective mounting member bodies 80 and 81, pairs of opposed flanges 82 and 83, stub ends or shafts 84 and 85, and resilient members or fingers 86 and 87. The hub sections 67 and 68 have respective axial aligned holes 88 and 89 in which the respective stub ends 84 and 85 are received. The holes 88 and 89, the roll-mounting portions 69 and 72, the projection 71, the hole 74, and the flanges 70 and 73 are in axial alignment.

The mounting portions 56 and 57 are shown to be provided with guide means in the form of slots 90 and 91. The slots 90 and 91 are preferably undercut, that is, slots 90 and 91 have respective flanges 92 and 93. The flanges 82 and 83 are in mating cooperation in respective slots 90 and 91 are and thus keyed therein. In assembling the ink roller 52 onto the inker body 53, the stub ends 84 and 85 of the mounting members 78 and 79 are inserted into the holes 88 and 89 of the assembled ink roller 52. The mounting members 78 and 79 are thereupon aligned with the slots 90 and 91 and the mounting members 78 and 79 are guided or slid along the slots 90 and 91 until free ends 86' and 87' of resilient members 86 and 87 snap outwardly and are trapped by respective shoulders or abutment faces 94 and 95 in the position best shown in FIG. 8. Thus, mounting portions 56 and 57 are considered to have snap-sockets S and S1. The members 78 and 79 are considered to be slides or guided members. Ends 80' and 81' of bodies 80 and 81 also abut respective shoulders 53' and 53'' of the body 53. The shoulders 53' and 53'' provide stops for the bodies 80 and 81 in one direction and the ends 86' and 87' provide stops for the bodies 80 and 81 in the other direction. The resilient member 86 and shoulders 53' and 94 are considered to constitute a lock and the resilient member 87 and shoulders 53'' and 95 are also considered to constitute a lock. In this position, the ink roller 52 is securely mounted to the inker body 53 and shafts 84 and 85 are in axial alignment with the ink roller 52. Shield portions 96 and 97 of the respective mounting portions 56 and 57 prevent the respective resilient members 86 and 87 from becoming accidentally dislodged from the locked positions shown, for example, in FIG. 8. If it were desired, however, to have the ink roller 52 removable from the inker body 53, the shields 96 and 97 would be omitted so that a tool or a fingernail for example could be used to deflect the respective resilient members 86 and 87 to cause them to clear the respective shoulders 94 and 95. The mounting members 78 and 79 could then be slid out of the slots 90 and 91, and the spent ink roller 52 could be replaced with a new ink roller 52 having a full supply of ink.

While it is preferred to have a lock for each member 78 and 79, if desired a lock could be provided on only one of the members 78 and 79.

In that the inker body 53 along with the mounting portions 56 and 57, the arms 54 and 55, the projections 64 and 65, and the spring 58 are of one-piece injection molded plastics construction and consequently very low in cost, it is often desired to replace the ink roller 52 together with the remainder of the inking mechanism. In this way, the user is assured of having a new spring finger 58 each time the ink roller 52 is changed. The hub sections 67 and 68, the mounting members 78 and 79, and the cover 36 with its projections 48, 49, 66 and 66' are each of one-piece integral injection molded plastics construction.

Other embodiments and modifications of this invention will suggest themselves to those skilled in the art, and all such of these as come within the spirit of this invention are included within its scope as best defined by the appended claims.

I claim:

1. An inking mechanism, comprising: an ink roller, an inker body having a pair of undercut slots and a pair of shoulders, and a pair of separate mounting members, each mounting member having a mounting member body, a pair of flanges joined to the mounting member body, a shaft joined at one end to the mounting member body, and a resilient finger joined to the mounting member body, the flanges of each mounting member being received in the respective slot in the inker body, and the resilient finger of each mounting member being cooperable with the respective shoulder of the inker body, each mounting member being of one-piece molded plastics construction.

2. An inking mechanism, comprising: an ink roller, an inker body having a pair of undercut slots, and a pair of separate mounting members, each mounting member having a mounting member body, a pair of flanges joined to each mounting member body, and a shaft joined at one end to each mounting member body, the flanges of each mounting member being received in the respective slot in the inker body, and means for locking the mounting members to the inker body, each mounting member being of one-piece molded plastics construction.

3. An inking mechanism, comprising: an ink roller having a roll composed of ink receptive material and a hub for mounting the roll, an inker body, means separate from the ink roller for mounting the hub to the inker body, means for locking the mounting means to the inker body including at least two shoulders, one shoulder limiting guided movement of the mounting means in one direction, and means cooperable with the other shoulder for limiting travel of the mounting means in the opposite direction, wherein the mounting means comprises a pair of separate one-piece molded plastics mounting members, the body having a pair of spaced apart slots, the mounting member having mating means for slidably guiding the respective mounting members in the slots.

4. An inking mechanism cooperable with a print head of a printing apparatus, comprising: an ink roller, an inker body for rotatably mounting the ink roller, means for movably mounting the inker body for movement between first and second positions, resilient means for releasably connecting the inker body to a printing apparatus, interference means for enabling the resilient means to be deflected to enable the inker body to be connected and disconnected from the printing apparatus while the inker body is disposed in the first position but preventing the inker body from being disconnected from the printing apparatus while the inker body is disposed in the second position, and means confining the inker body for movement only within the second position while the inker body is connected to the printing apparatus.

5. An inking mechanism, comprising: an ink roller, an inker body for rotatably mounting the ink roller, a cover, and means for releasably and movably mounting the inker body to the cover, the mounting means including a resilient member connected to one of the inker body and the cover, and interference means connected to the other of the inker body and the cover for enabling the resilient member to move to enable connection and disconnection of the inker body from the cover in a first position of the inker body relative to the cover and for preventing movement of the resilient member to prevent disconnection of the inker body from the cover when the inker body is in the second position, the inker body being only movable within the second position when the cover is mounted to a printing apparatus and the ink roller is in cooperation with the print head.

6. An inking mechanism cooperable with a print head of a printing apparatus, comprising: an ink roller, an inker body for rotatably mounting the ink roller, the inker body having a pair of arms, means for movably mounting the inker body comprising a pair of spaced-apart mounting members, means for releasably coupling the arms to the mounting members, and a projection connected to the mounting means and at least partially offset from the mounting members for enabling the one arm to be coupled to and uncoupled from the mounting members in one position of the inker body and for preventing the arm from being uncoupled in a second operative inking position in which ink roller is cooperable with a print head.

7. An inking mechanism as defined in claim 6, including a spring connected to the inker body, the projection being disposed between the spring and of the mounting members.

8. An inking mechanism as defined in claim 6, wherein there is another projection connected to the mounting means and offset from the mounting members for enabling the other arm to be coupled to and uncoupled from the mounting members in the one position and for preventing the other arm from being uncoupled in the second position.

9. An inking mechanism cooperable with a print head of a printing apparatus, comprising: an ink roller, an inker body for rotatably mounting the ink roller, the inker body having a pair of arms, means for movably mounting the inker body comprising a pair of spaced-apart mounting members, an aperature in each mounting member, the inker body having first and second arms, first and second pivots on the respective first and second arms, the first pivot being relatively long and the second pivot being relatively short, a projection connected to the mounting means and at least partially offset from the mounting member to which the second arm is coupled for enabling the second arm and thereafter the first arm to be uncoupled from the respective first and second mounting members in one rotational position of the inker body and for preventing the second arm from being uncoupled in a second operative inking position in which the ink roller is cooperable with the print head.

10. An inking mechanism, comprising: an ink roller including a pair of connected hub sections, each hub section having a roll mounting portion and a flange, an ink receptive tubular porous roll received by the roll-mounting portions between the flanges and an axially extending outwardly opening hole in each hub section, an inker body, and means for mounting the ink roller to the inker body, the mounting means including a pair of separate mounting members, each mounting member having a shaft received in the hole in the respective hub section, and locks spaced from the respective shafts and formed partly by the respective mounting members and partly by the inker body for locking the mounting members to the inker body.

11. An inking mechanism as defined in claim 10, wherein the mounting members are of one-piece molded plastics construction.

12. An inking mechanism as defined in claim 10, wherein each lock includes a resilient finger on one of the mounting member and the inker body and a shoulder on the other of the mounting member and the inker body.

13. An inking mechanism, comprising: an ink roller, an inker body, and means for mounting the ink roller to the inker body, the mounting means including a pair of mounting members, and a lock for at least one mounting member, the lock including a shoulder and a resilient member engaged with the shoulder, the inker body having a pair of undercut slots, each mounting member having flange means keyed for slidable movement into the respective slot, the resilient member being effective when the one mounting member is slid into its respective undercut slot to lock the one mounting member to the inker body.

14. An inking mechanism, comprising: an ink roller having a roll composed of ink receptive material and a hub for mounting the roll, a inker body having at least one shoulder, and a pair of separate mounting members, each mounting member having a mounting member body and shaft means mounted to the mounting member body for rotatably mounting the hub, and a resilient member connected to at least one of the mounting member bodies, spaced from the respective shaft means and cooperable with the shoulder so that the ink roller is connected to the inker body.

15. An inking mechanism, comprising: an ink roller having a roll composed of ink receptive material and a hub for mounting the roll, an inker body, and a pair of separate mounting members for mounting the hub to the inker body, means mating with the mounting members for slidably guiding and keying the mounting members into a selected position with respect to the inker body, means for locking at least one of the mounting members to the inker body in the selected position, and the locking means including a resilient member on at least one mounting member.

16. An inker mechanism as defined in claim 15, wherein the locking means includes a resilient member related to each mounting member.

17. An inking mechanism, comprising: an ink roller having a roll composed of ink receptive material and a hub for mounting the roll, an inker body, and a pair of mounting members for mounting the hub to the inker body, means guiding the mounting members for sliding movement into a selected position with respect to the inker body, and means for locking the mounting members to the inker body, wherein each mounting member includes a shaft received by the ink roller, the locking means includes a pair of shoulders on the inker body, and a resilient member on each mounting member, spaced from the respective shaft and cooperable with the respective shoulder.

18. An inking mechanism, comprising: an ink roller having opposed end portions, an inker body, a pair of separate mounting members, slot means keying the mounting members to the body for sliding movement, the body having first and second shoulders, one of the mounting members including a third shoulder cooperable with the first shoulder and effective when the one mounting member has been slid along the slot means in one direction to a predetermined position for preventing further sliding movement, the one mounting member further including a resilient member having a fourth shoulder cooperable with the second shoulder when the one mounting member is in the predetermined position to prevent the one mounting member from sliding out of the predetermined position, and each mounting member having means for rotatably mounting one end portion of the ink roller.

19. An inking mechanism, comprising: an ink roller having opposed end portions, an inker body, a pair of separate mounting members, slot means keying the mounting members to the body for sliding movement, the body having two pairs of first and second shoulders, each mounting member including a third shoulder cooperable with the respective first shoulder and effective when it has been slid along the slot means in one direction to a predetermined position for preventing further sliding movement, each mounting member further including a resilient member having a fourth shoulder cooperable with the respective second shoulder when it is in the predetermined position to prevent it from sliding out of the predetermined position, and each mounting member having means for rotatably mounting one end portion of the ink roller.

* * * * *

UNITED STATES PATENT AND TRADEMARK OFFICE

CERTIFICATE OF CORRECTION

PATENT NO. : 4,044,677

DATED : August 30, 1977

INVENTOR(S) : Paul H. Hamisch, Jr.

It is certified that error appears in the above-identified patent and that said Letters Patent are hereby corrected as shown below:

Column 3, line 52, "inker" has been misspelled. Column 4, line 67, "rollmounting" should be hyphenated. Column 5, line 4, "rollmounting" should be two words; line 8, "75 b" should be --75b--; line 63, "and" should be --or--.

Applicant's error

Column 7, line 33, after "and" insert --one--.

Signed and Sealed this

Sixteenth Day of May 1978

[SEAL]

Attest:

RUTH C. MASON
Attesting Officer

LUTRELLE F. PARKER
Acting Commissioner of Patents and Trademarks